US007445258B2

(12) United States Patent
Rice et al.

(10) Patent No.: US 7,445,258 B2
(45) **Date of Patent: *Nov. 4, 2008**

(54) POWER LINEAR DISPLACEMENT STRIKER

(75) Inventors: John R. Rice, Marshall, IL (US); Frank Joseph Arabia, Jr., Macomb, MI (US); Jeffrey S Hamminga, Macomb, MI (US); Joseph Michael Johnson, Huntington Woods, MI (US)

(73) Assignee: Delphi Technologies, Inc., Troy, MI (US)

( * ) Notice: Subject to any disclaimer, the term of this patent is extended or adjusted under 35 U.S.C. 154(b) by 112 days.

This patent is subject to a terminal disclaimer.

(21) Appl. No.: 11/347,800

(22) Filed: Feb. 3, 2006

(65) Prior Publication Data

US 2006/0175846 A1 Aug. 10, 2006

Related U.S. Application Data

(60) Provisional application No. 60/650,661, filed on Feb. 7, 2005, provisional application No. 60/714,704, filed on Sep. 7, 2005.

(51) Int. Cl.
*E05C 15/02* (2006.01)

(52) U.S. Cl. ..... 292/341.16; 49/280

(58) Field of Classification Search ..... 292/201, 292/341.16; 49/280

See application file for complete search history.

(56) References Cited

U.S. PATENT DOCUMENTS 2,903,288 A * 9/1959 Joachim et al. ..... 292/341.16
4,707,007 A 11/1987 Inoh
4,775,178 A * 10/1988 Boyko ..... 292/341.16
4,982,984 A 1/1991 Yokota et al.
5,004,280 A 4/1991 Schap
5,039,925 A 8/1991 Schap
5,063,710 A 11/1991 Schap
5,066,056 A 11/1991 Schap
5,172,947 A 12/1992 Schap
5,429,400 A 7/1995 Kawaguchi et al. ..... 292/201
5,443,292 A 8/1995 Shimada et al. ..... 292/341.16
5,456,283 A 10/1995 Schap
5,582,279 A 12/1996 Buchanan, Jr. et al.
5,644,869 A 7/1997 Buchanan, Jr.
5,740,894 A 4/1998 Buchanan, Jr. et al.
5,755,059 A 5/1998 Schap
5,755,468 A 5/1998 Buchanan, Jr.
5,765,886 A * 6/1998 Buchanan, Jr. ..... 292/341.16
5,787,636 A 8/1998 Buchanan, Jr.
5,906,071 A 5/1999 Buchanan, Jr.
6,193,288 B1 * 2/2001 Taga et al. ..... 292/341.16
6,550,825 B2 4/2003 Ostrowski et al.

* cited by examiner

*Primary Examiner*—Gary Estremsky
(74) *Attorney, Agent, or Firm*—Patrick M. Griffin

(57) ABSTRACT

A power striker assembly effects final positioning of a vehicle closure member and includes a fixed frame and a striker member carried on a striker plate for selective engagement of a latch carried on the closure member, to displace the closure member from a presented position to a cinched position. Guide means interconnects the frame and striker plate to effect simultaneous translational and rotational displacement of the striker plate between end limits of travel to produce linear displacement of the striker member. An actuator selectively displaces the striker plate between its end limits of travel in response to a control signal. Finally, an interlock fixes the striker plate in the cinched position in the absence of the control signal.

17 Claims, 9 Drawing Sheets

POWER LINEAR DISPLACEMENT STRIKER

RELATED PATENT APPLICATIONS

The present application claims priority to provisional application U.S. Ser. No. 60/650,661, filed 7 Feb. 2005, entitled "Power Cinching Striker", and provisional application U.S. Ser. No. 60/714,704, filed 7 Sep. 2005, entitled "Power Cinching Striker". The present application is related to U.S. patent application Ser. No. 11/347,799, entitled "Power Striker with Manual Override" , filed on even date herewith and owned by a common assignee of interest.

TECHNICAL FIELD

The present invention, although useful in other applications, relates to an active door latch assembly which ensures easy and reliable final closure of a vehicle door by moving the striker toward the center of the vehicle body when the vehicle door is about to be fully closed and moving the striker away from the center of the vehicle body when the vehicle door is in the process of being opened. More particularly, the present invention relates to an improved active door latch assembly, which can operate more reliably and cost effectively than was possible heretofore.

BACKGROUND OF THE INVENTION

A final closing device for a closure member on a vehicle body, and more particularly, a device for moving a vehicle-mounted closure member (e.g., a sliding door, a hinged door, a hood, a trunk lid, or the like) from a nearly closed position, at which a latch bolt or member engages a striker, to a fully closed position, at which the closure member is sealingly engaged with the vehicle body, is well known.

A typical standard automotive door latch striker assembly includes a striker, which can take the form of a pin, a U-shaped member or the like, fixedly mounted in the door frame to project into the door opening and into the path of movement of a latch member mounted on the edge of the door, which includes a fork bolt therein. The latch member is typically movably mounted with respect to the door and arranged so that as the door approaches its closed position, the latch member will engage the striker and further closing movement of the door will move the latch member into a safety latch position with respect to the pin, sometimes referred to as the secondary latch position, and further closing movement of the door will move the latch member into a primary latch position with respect to the pin, which positively retains the door against movement away from its closed position. It is generally known for at least part of the movement of the latch member into latched relationship with the striker to be resisted by a spring, and many users of sliding doors of this type habitually close the door with far greater force than necessary to overcome the spring bias. Greater force is generally required in the case of sliding doors, such as those employed in vans, where movement of the door through the final phase of movement to the fully closed position must encompass a resilient door seal, which extends around the entire periphery of the door opening.

Power striker devices have been proposed to overcome the high force requirements to move sliding doors into the fully closed position. Typically the power striker devices are mounted on the door frame for powered movement between an outboard ready position with respect to the vehicle center line, where the latch is engaged with the striker, and an inboard holding position, where the striker holds the latch in the fully closed position. It is still required in such systems to use high force or momentum in order to ensure that the latch engages the striker in the primary latch position prior to movement into the fully closed position. When the door is open, the striker is located in its outboard ready position. After closing translation of the door is complete, the latch on the door engages the striker and latches the door to the striker while the striker is still in the outboard position. The door may engage a limit switch on the door frame when in the outboard position or may be sensed by a position sensor on the translator, which is a separate motor which drives the door between its relative positions, to actuate a drive motor which, through appropriate mechanism, drives the striker to its inboard position, such that the latched engagement between the door and striker enables the pin to drive the door to the fully closed position. With this arrangement, a closing force sufficient to engage the latch to the primary latch position with respect to the striker needs to be applied. The powered movement of the striker provides the force necessary to compress the door seal. If the striker and latch do not reach the primary latch position with respect to one another, the powered movement of the striker from its outboard position to its inboard position would not be sufficient to bring the door to the fully closed position in sealed engagement with the frame around the periphery of the door opening. In such cases, the user may be required to reopen and close the door repeatedly until the latch and striker are disposed in the primary latch position with respect to each other when in the outboard position.

For the purpose of preventing the intrusion of rain water and so on, a seal member, which is molded typically from synthetic rubber and is generally called weather strip, is interposed in a gap between a door and an associated vehicle body. Recently, with the aim of reducing the wind noise and noises from air leakage in addition to improving the sealing effect, weather strips of higher reaction force or, in other words, weather strips having higher elastic coefficients are being preferred. This high reaction force tends to prevent a full latching of the door latch upon closing of the door and may cause only a partially closed state of the door. Therefore, it is sometimes necessary to forcibly close the door to overcome the reaction force of the weather strip and to obtain a fully latched state of the door latch. However, when the door is forcibly closed, the sound thereof and the resulting sudden change in the cabin pressure may cause discomfort to the passenger.

To resolve this problem, it is conceivable to move a striker, by a suitable means, which is mounted to the vehicle body to engage with a latch assembly mounted to the door to keep the door closed. Specifically, the striker may be placed at an outward position in advance so as to achieve a latching before the reaction force of the weather strip starts acting upon the door and, after the door latch assembly is fully latched to the striker, the striker is positively driven to a position which causes complete deformation of the weather strip for sufficient sealing effect and complete closure of the door.

However, in order to pull in the striker from its latched position against the reaction force of the weather strip, an extremely strong force is necessary. Suitable actuators for driving the striker are difficult to package and install in the limited space in the interior of the associated body panel structure. It is particularly difficult to package such a drive device in the center pillar of a four-door passenger vehicle.

The final closing systems employed in prior art examples are generally large, costly, complicated mechanisms which are difficult to install, repair and/or replace and have frequently proven to be unsatisfactory in terms of long term performance and reliability. Furthermore, modifying striker actuators for varying applications and vehicle configurations typically requires major redesign and retooling.

Known power striker systems which are designed for flexibility of application tend to be underpowered, resulting in slow operation and a tendency to stall. Furthermore, if their design is not robust, the mechanism can be easily damaged by slamming of the door.

A particular problem common to existing power striker systems stems from the arcuate path of travel of the striker as it traverses from the presented or deployed position to cinched or closed position. This is problematic inasmuch as the mating latch assembly must be able to maintain secure interconnection with the striker as it traverses vertically and/or longitudinally as well as inwardly. In a related problem, electrically driven systems do not have adequate redundancy and can fail without the door being in the fully closed and positively latched condition.

It is, therefore, a primary object of the present invention to provide an improved final closing device for closure members of vehicles which overcomes known shortfalls of existing devices without adding to part count, manufacturing complexity or cost.

SUMMARY OF THE INVENTION

Generally, the present invention fulfills the forgoing needs by providing, in one aspect thereof, a compact, power cinching striker, which allows for linear motion of the striker pin while the supporting striker plate rotates about the striker pins pivot point.

In another aspect, the present invention provides a loss of power over-ride feature enabling cinching without power when presented with normal manual operation of the vehicle closure system.

The presently inventive power striker assembly operates to effect final positioning of a closure member on an associated vehicle and includes a fixed frame which is adapted for attachment to the host vehicle at a location adjacent the closure member, a striker member which is positionable to selectively engage a mating latch mechanism carried by the closure member and acts to displace the closure member from an extended or open position to a retracted or closed position. The striker member is carried by a striker plate which is interconnected with the fixed frame by guide means that effects simultaneous translational and rotational displacement of the striker plate between first and second end limits of travel resulting in substantially linear displacement of the striker member between the extended and retracted positions. Finally, actuator means is provided to selectively displace the striker plate between its end limits of travel. This arrangement ensures true linear translation of the striker pin or member, simplifying the design of its interface with the mating latch assembly and enhancing operational performance. Furthermore, the depicted simplified design allows for a stackable assembly process to enhance quality while reducing investment. Also, the cinching striker design is compact and flexible enough to function in numerous vehicle applications in a cost effective manner.

According to another aspect of the invention, the guide means includes first and second bushings carried with the frame which are in respective continuous sliding engagement with first and second guide surfaces throughout transition of the striker plate between its end limits of travel. Furthermore, the striker plate is substantially flat and displaceable within a two-dimensional plane defined by the frame. This arrangement has the advantage of providing an extremely compact yet robust mechanism able to withstand high overload conditions.

According to another aspect of the invention, sensor means are provided to sense the position of the striker plate, and thus, the striker member, and to provide a feedback signal to the actuator. This arrangement has the advantage of effecting precise control of the power striker assembly.

According to still yet another aspect of the invention, a uni-directional permanent magnet motor is employed to effect both cinching and presenting striker member displacement during such one directional operation. This arrangement has the advantage of an extremely simple, low cost design.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

Although the drawings represent embodiments of the present invention, the drawings are not necessarily to scale and certain features may be exaggerated in order to better illustrate and explain the present invention. The exemplification set forth herein illustrates an embodiment of the invention, in one form, and such exemplifications are not to be construed as limiting the scope of the invention in any manner.

DESCRIPTION OF THE PREFERRED EMBODIMENT

The present invention is intended for application in varied automotive vehicle applications and will be described in that context. It is to be understood, however, that the present invention could also be successfully applied in many other applications. Accordingly, the claims herein should not be deemed limited to the specifics of the preferred embodiment of the invention described hereunder.

Figure 1:
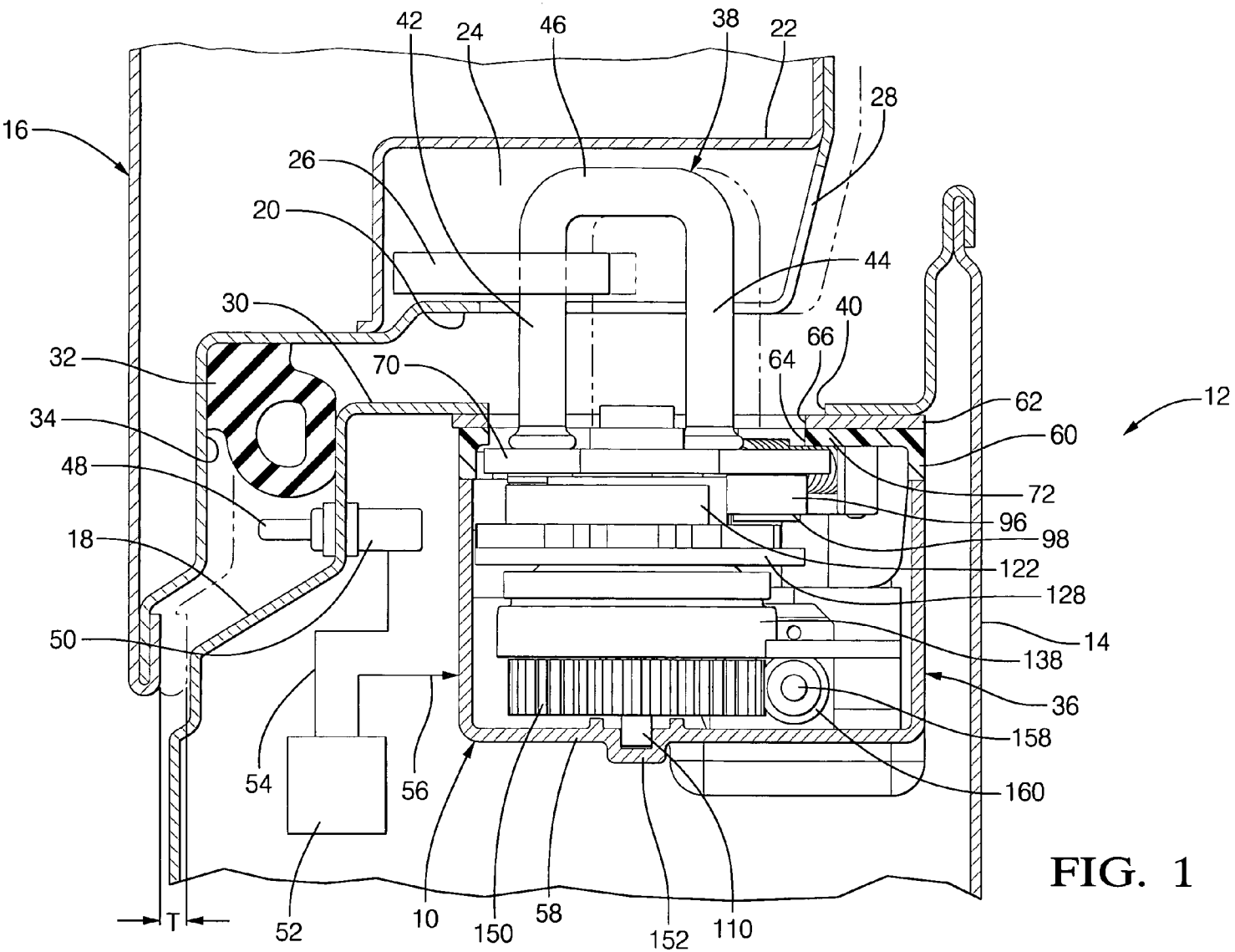
FIG. 1, is a broken, sectional view of the preferred embodiment of a power cinching striker assembly embodying the present invention in application providing final closure of a sliding side door of a motor vehicle.

Referring to FIG. 1, a power cinching striker assembly 10 is illustrated installed within its preferred environment of a motor vehicle 12. Vehicle 12 defines a body 14 and at least one movable panel or closure member 16 attached to and carried by the body 14 via hinges, pivots, guide tracks or the like for translation between open and closed positions. In the illustrated embodiment of the invention, the striker assembly 10 is installed within a van-type vehicle including a sliding side door and will be described in that context. However, it is contemplated that the present invention can be employed with equal success in other applications and with other types of closure members such as hinged doors, lift gates, windows, trunk lids, hoods and various access panels.

FIG. 1 is a schematic diagram, as viewed from above, of a portion of an opening 18 in vehicle 12 for receiving closure member 16. A number of details are deleted or simplified for the sake of clarity, it being understood that the basic structure, operation and guide support of a van sliding door is well known.

In application, closure member 16 can assume three distinct positions, as well as any number of transitional intermediate positions. When in a fully open position (not illustrated) closure member 16 is displaced from opening 18 to provide user access to the interior of the vehicle 12. As illustrated in FIG. 1, closure member 16 is substantially registered with its associated opening 18. Closure member 16 is depicted in solid line in a "presented" or "pre-latched" position, and in phantom in a "closed" or "cinched" position.

The portion of closure member 16 illustrated in FIG. 1 has a jamb face 20 co-acting with an internal structural member 22 to define a cavity 24 containing a latch 26 of conventional design. Latch 26 is disposed adjacent an opening 28 in jamb face 20 facing an adjacent wall 30 of body 14 defining opening 18. A weather strip or seal 32 is affixed to a convex wall surface 34 outboard of jamb face 20 and extends around the entire periphery of closure member 16.

Figure 3:
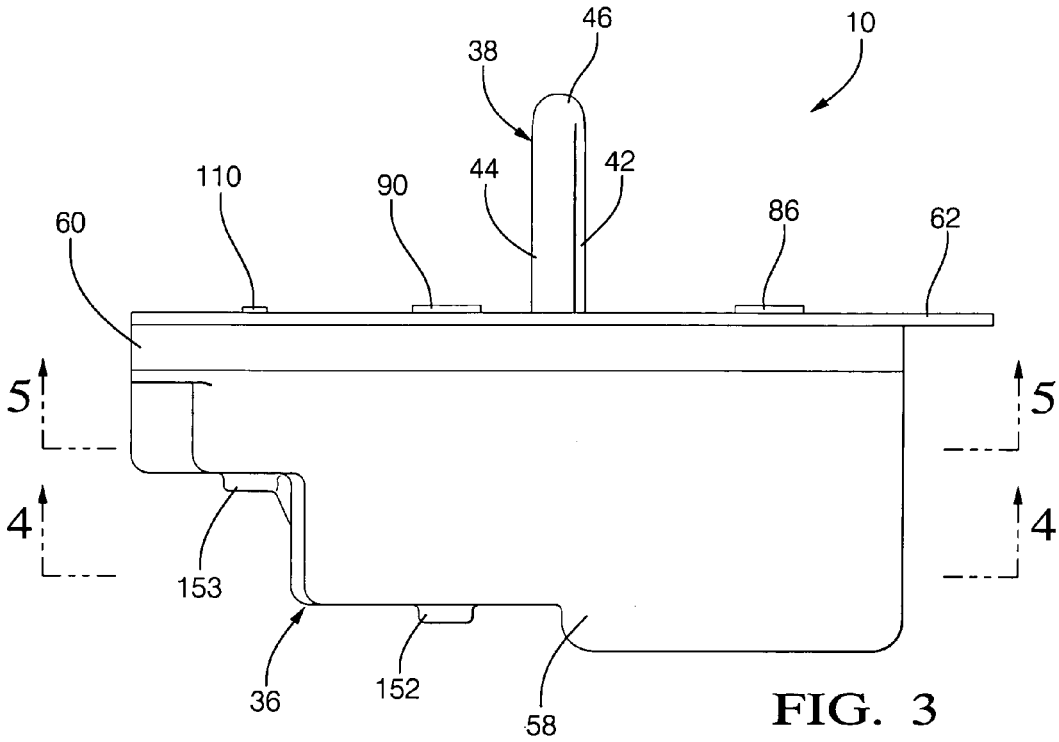
FIG. 3 is a front perspective view of the power cinching striker assembly of FIG. 1.

Referring to FIGS. 1 and 3, power cinching striker assembly 10 comprises a housing assembly 36, which sealingly encloses all of its internal components. A striker member 38 depends outwardly from and is actively supported by housing assemble 36. Housing assembly 36 is fixedly mounted to the inner surface of the wall 30 defining closure member opening 18, with striker member 38 extending outwardly through an elongated opening 40 in wall 30. Striker member further extends through opening 28 of closure member 16 and into cavity 24 to engage latch 26. Although not illustrated, it is contemplated that a decorative and protective elastomeric seal can be employed to close opening 40 to prevent intrusion of water and environmental contaminates but without interfering with reciprocating displacement of striker member 38.

Striker member 38 is preferably "u" shaped, consisting of a first or striker leg 42, a second or support leg 44 and an interconnecting bridge portion 46. Definitionally, for purposes of interpretation of the claims, the striker leg 42 is a "striker member", and the second leg 44 and bridge member 46 are non-functional, other than providing structural support. As an alternative, striker member 38 could be replaced by a single cantilever striker pin.

When closure member 16 is manually moved or power driven from a fully or partially open position into its illustrated presented position, inertia of the moving closure member 16 will cause the latch 26 to contact and self-engage with the striker leg 42 or striker member 38. Simultaneously, an inner surface of closure member 16 will contact and displace the plunger 48 of a door switch 50, which is fixedly secured to a suitable place in the side surface or wall 30 of opening 18. Plunger 48 is biased outwardly by a spring (not illustrated) and operates to change the conductive state of internal electrical contacts (not illustrated) interconnected with a control circuit 52 by lead wires 54. Control circuit 52 is also electrically in-circuit with power striker assembly 10 through intermediate control lines 56.

Control circuit 52 can be integrated into the body computer of the host vehicle 12 or be stand-alone. Control circuit 52 includes a power source for selectively electrically energizing the power striker assembly.

Door switch 50 preferably contains a plurality of normally open or normally closed contact pairs, which provide a closure member position signal to control circuit 52 via lead wires 54. It is further contemplated that the mechanism (not illustrated) with the latch 26 can operate under electrical or manual control, which may include position sensors. The outputs of such sensors could be used to provide additional inputs to control circuit 52.

Whenever the closure member 16 is in a partially or fully opened position (not illustrated), control circuit 52 has previously provided a control signal via lines 56 to effect positioning of striker member 38 in its illustrated (solid line) presented or pre-latch position in FIG. 1. When the closure member 16 is displaced to its illustrated (solid line) presented position and striker member 38 engages latch 26, plunger 48 of door switch 50 is partially depressed, causing control circuit 52 to send a control signal to the power striker assembly 10 which will translate the striker member 38 from its solid line position to its phantom position. Insodoing, the striker member will draw the latch 26, as well as the illustrated portion of the closure member 16, inwardly to its illustrated (in phantom) cinched or closed position, a dimension designated by arrow T. This translation compresses the seal 32 about the periphery of the closure member 16 to effect a substantially water tight seal.

The power cinching striker assembly 10 described herein has proven to be an extremely robust, utilitarian design. For example, one particular design provides 6.0-10.0 mm of linear striker pin displacement and is capable of cinching up to 1200 N of force at various temperature and environmental extremes. The high efficiency of the design results in an actuation time of less than 2.0 seconds to displace the striker pin linearly 6.0 mm when under load. The design is extremely flexible and can be easily and inexpensively modified to accommodate various load profiles required for specific vehicle seal force requirements.

As will described herein below, the preferred power cinching striker design allows for linear motion of the latching pin while the striker plate rotates about its pivot points. This effectively eliminates undesirable striker pin non-linear translation associated with prior art designs. This simplified design allows for variable striker pin positioning relative to the main footprint of the mechanism without sacrificing the linear displacement mentioned above. This results in a design, which can be tailored towards both lift gate and sliding door applications.

Figure 2:
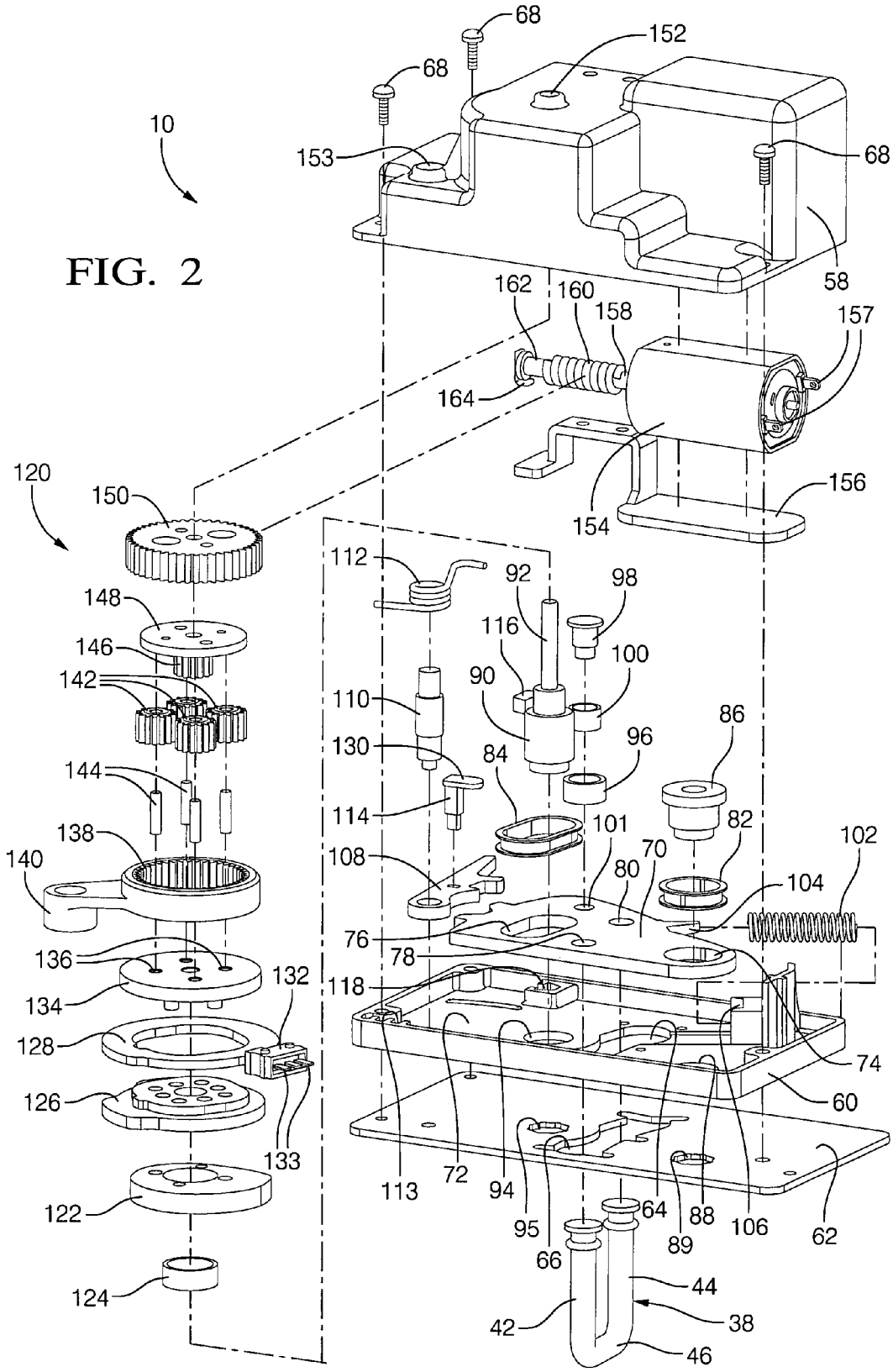
FIG. 2, is an exploded, perspective view of the preferred power cinching striker assembly of FIG. 1.

Referring to FIGS. 1 and 2, the internal details of the various structural components of the power cinching striker assembly are illustrated. Housing assembly 36 comprises upper and lower housing portions 58 and 60, respectively, which are preferably molded of thermoplastic material and a generally planar cover plate 62, which is preferably formed of mild steel, underlying the lower surface of lower housing 60. Housing portions 58 and 60 enclose the below described components, with the exception of the striker member 38, which extends downwardly through registering elongated openings 64 and 66 formed in lower housing portion 60 and cover plate 62, respectively. Cover plate 62 serves to structurally reinforce striker assembly 10 and provides a robust mounting surface to the wall 30 of opening 18 of vehicle 12. Openings 64 and 66 of striker assembly 10 are registered with opening 40 in wall 30 to permit the non-interfering through passage of the striker member 38 in both its cinched and presented positions. Housing portions 58 and 60 and cover plate are retained in assembly by suitable fastener means such as screws 68.

A substantially flat, sector shaped, elongated striker plate 70 is disposed parallel to and adjacent the upper surface of the bottom wall 72 of lower housing portion 60. As will be described in greater detail herein below, striker plate 70 is mounted for limited simultaneous translation and rotation between first and second end limits of travel in an imaginary two-dimensional plane parallel to the bottom wall 72 of lower housing portion 60. A first elongated slot 74 extends through striker plate 70 adjacent its apex. The first slot 74 has a characteristic line of elongation extending generally parallel to the line of elongation of the striker plate 70. A second, crescent shaped elongated slot 76 extends through striker plate 70 at the opposite (hereinafter "enlarged") end thereof. The second slot has a characteristic line of elongation substantially offset from the line of elongation of the first slot 74.

Legs 42 and 44 of striker member 38 extend through spaced through holes 78 and 80, respectively, and are permanently affixed thereto such as by peening or swedging. As assembled, striker plate 70 and striker member 38 function as a single unitary structure.

A first elongated bushing 82 is fixedly disposed within the first elongated slot 74 for displacement with striker plate 70. A second elongated bushing 84 is fixedly disposed within the second elongated slot 76 for displacement with striker plate 70. A first headed cylindrical bearing 86 extends downwardly through bushing 82 and is affixed with bottom wall 72 of lower housing portion 60 and cover plate 62 via registering through passages 88 and 89, respectively. Likewise, a second bearing 90, which is integrally formed as part of a stepped drive axle 92, extends downwardly through bushing 84 and is affixed with bottom wall 72 of lower housing portion 60 and cover plate 62 via registering through passages 94 and 95, respectively. Thus assembled, striker plate is held in assembly with lower housing portion 60 and is limited to the above-described simultaneous translational and rotational two-dimensional displacement between first and second limits of travel.

A roller bearing 96 is carried for rotation on a headed rivet pin 98 through an intermediate roller pin bushing 100. Rivet pin 98 is press fit within a registering through passage 101 formed in striker plate 70 spaced from one end of bushing 84. As will be described herein below, bearing 96 is free to rotate about pin 98 and is carried for translation with striker plate 70, functioning as a cam follower.

A compression spring 102 has one end affixed to an edge of striker plate 70 via an integral tang feature 104 and the opposed end bearing against an abutment surface 106 integrally formed within lower housing portion 60. Spring 102 serves to continuously urge striker plate 70 counter-clockwise as viewed in FIG. 2, towards a limit of travel corresponding with the striker member 38 being in the presented position.

Striker plate 70 end of travel position retention is effected by a detent lever or pawl 108 disposed adjacent the enlarged end of the striker plate 70. Detent lever 108 is disposed to be co-planar with striker plate 70 and has one end thereof pivotally affixed to the bottom wall 73 of lower housing portion 60 via a detent stud 110. Detent lever 108 and the adjacent side wall of striker plate 70 define cooperating ramp and abutment surfaces to effect certain latch and detent functionality which will be described herein below.

A detent torsion spring 112 has a loop portion concentrically carried by detent stud 110. One radially extending leg of spring 112 is fixedly retained by an engagement feature 113 integrally formed in a wall portion of lower housing portion 60. A second radially extending leg of spring 112 continuously bears against a detent stud pin 114 carried with detent lever 108. Thus arranged, torsion spring 112 continuously urges detent lever 108 in a clock-wise direction and into contact with striker plate 70. Rotational travel of detent lever 108 is limited by rubber detent stop bumper 116 fixedly carried by a retention feature 118 integrally formed in lower housing portion 60.

A drive mechanism 120 is disposed concentrically upon drive axle or shaft 92. A striker plate cam 122 is carried on shaft 92 through an intermediate bushing 124. Thus, cam 122 is carried by, but is free to rotate about shaft 92. A detent lever cam 126 and a switch cam 128 are stacked upon striker plate cam for rotation therewith. Striker plate cam 122 is aligned for rolling engagement with roller bearing 96 to effect positioning of the striker plate 70 (and striker member 38) as a function of the angular position of striker plate cam 122. Likewise, detent lever cam 126 is aligned for sliding engagement with a follower 130 integrally formed on the free end of detent stud pin 114 for selectively rotating detent lever 108 into and out of engagement with the adjacent end surface of striker plate 70 as a function of the angular position of detent lever cam 126. Furthermore, switch cam 128 is aligned for sliding engagement with a contact switch 132, which has a plurality of electrical terminals 133 which are electrically in circuit with control circuit 52 to selectively enable or disable the control signal as a function of the angular position of switch cam 128. Control switch 132 is appropriately mounted by internal features (not illustrated) preferably integrally formed within upper housing portion 58 of housing assembly 36.

A phasing carrier 134 is concentrically disposed on switch cam 128 and serves to key the three cams 122, 126 and 128 for rotation in unison about shaft 92. Carrier 134 defines four circumferentially arranged axle receiving bores 136. A ring or spur gear 138 is concentrically disposed above carrier 134 and is grounded by an integral extension 140, which is fixedly attached to the upper free end of detent stud 110. Each of four planetary gears 142 are carried for rotation about a separate axle 144 extending upwardly from a respective axle receiving bore 136. A sun gear 146 is carried for rotation on shaft 92 and is positioned concentrically with ring gear 138 and the intermediate circumferential array of planetary gears 142 to effect a gear reduction there between as is well known. Sun gear 146 includes an integral flange 148 for affixation with a large helical gear 150. Shaft 92 extends through helical gear 150 and terminates in a support bushing feature 152 integrally formed in upper housing portion 58. Likewise, detent stud 110 extends above torsion spring 112 and terminates in a support bushing feature 153 integrally formed in upper housing portion 58.

A permanent magnet D.C. motor 154 controlled for unidirectional operation is affixed to upper housing portion 58 via a motor retainer bracket 156. Control lines 56 (FIG. 1) are extended to electrical terminals 157 of motor 154, placing it in circuit with control circuit 52. The armature shaft 158 of motor 154 carries a worm gear 160 for rotation therewith. The cantilevered free end of armature shaft 158 is supported axially and radially by a motor worm bearing 162 and a thrust plate 164, which are secured in assembly with upper housing portion 58 by integral or discrete features (not illustrated).

Figure 4:
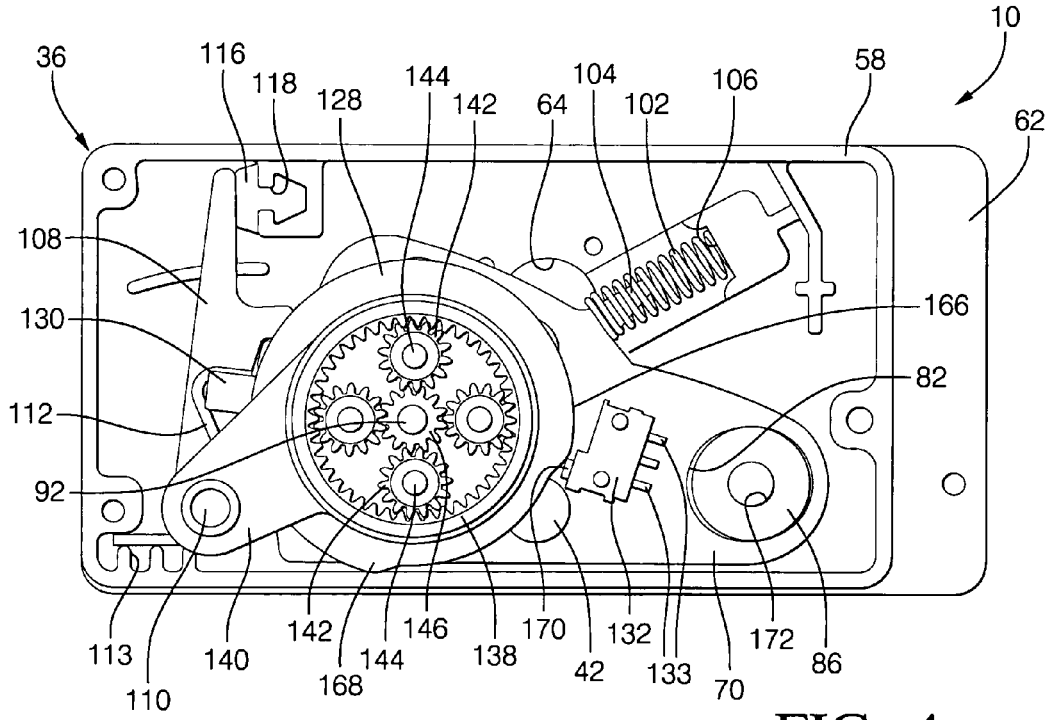
FIG. 4, is a cross-sectional view of the power cinching striker assembly taken on lines 4-4 of FIG. 3, on an enlarged scale.

Referring to FIG. 4, the juxtaposition of specific internal components of striker assembly 10 is illustrated. Specifically, the arrangement of the portion of the power transmission, including the ring gear 138, the planetary gears 142 and the sun gear 146 can be clearly seen. The depicted preferred design provides reduced gear speed which, with optimized material selection provides quality sound during the cinching operation. It is to be understood that the gear ratios, as well as component dimensions, materials, surface finishes and the like will vary, depending upon the specific application contemplated, as should be apparent to one of ordinary skill in the art.

Switch cam 128 has an outer peripheral surface 166 defining a single lobe 168 extending circumferentially approximately 270 degrees. Cam surface 166 is in sliding contact with a spring-loaded plunger 170 of contact switch 132, which changes conductive state of switch 132 as a function of the angular position of the cam lobe 168. The configuration and phasing of the cam lobe 168 can be varied depending upon the intended application.

Referring to FIGS. 1 through 4, bearing 86 defines an axial through passage 172 which is threaded to receive a bolt or other suitable fastener (not illustrated) extending through wall 30 of vehicle opening 18 and through passage 89 of cover plate 62 to effect attachment of striker assembly 10 to the host motor vehicle 12 at a location adjacent closure member 16. Similarly, a threaded blind bore (not illustrated) is formed in bearing 90 of drive axle 92 to receive a second bolt or suitable fastener extending through wall 30 of vehicle opening 18 and through passage 95 of cover plate 62. This arrangement is very robust, and directs impact forces from the striker member 38 through the striker plate 70 and bearings 86 and 90, directly to the body 14 of the motor vehicle 12 and avoids high force loading of the transmission components.

Figure 5:
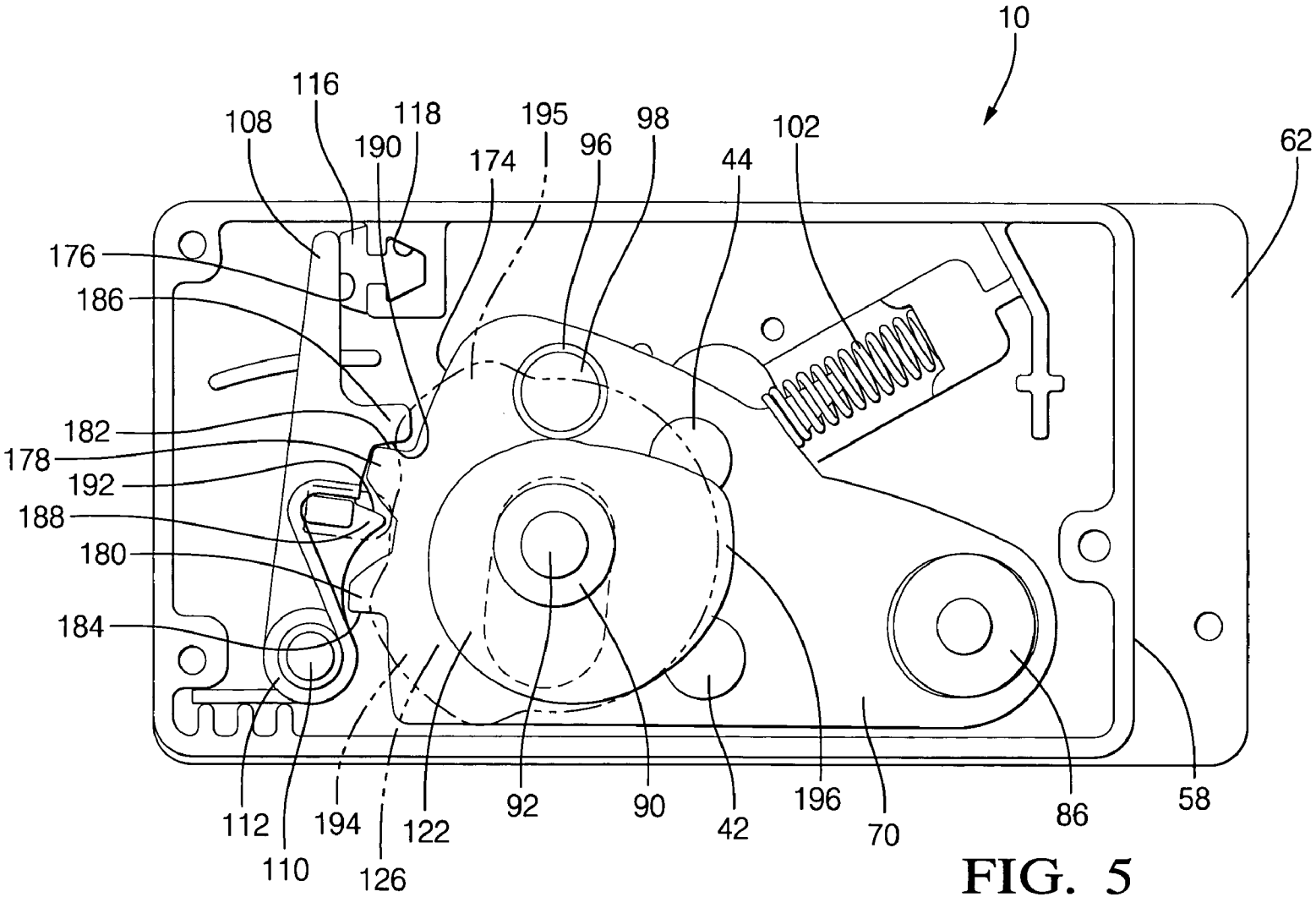
FIG. 5, is a cross-sectional view of the power cinching striker assembly taken on lines 5-5 of FIG. 3, on an enlarged scale, illustrating the striker and striker plate disposed in the presented position.
Figure 6:
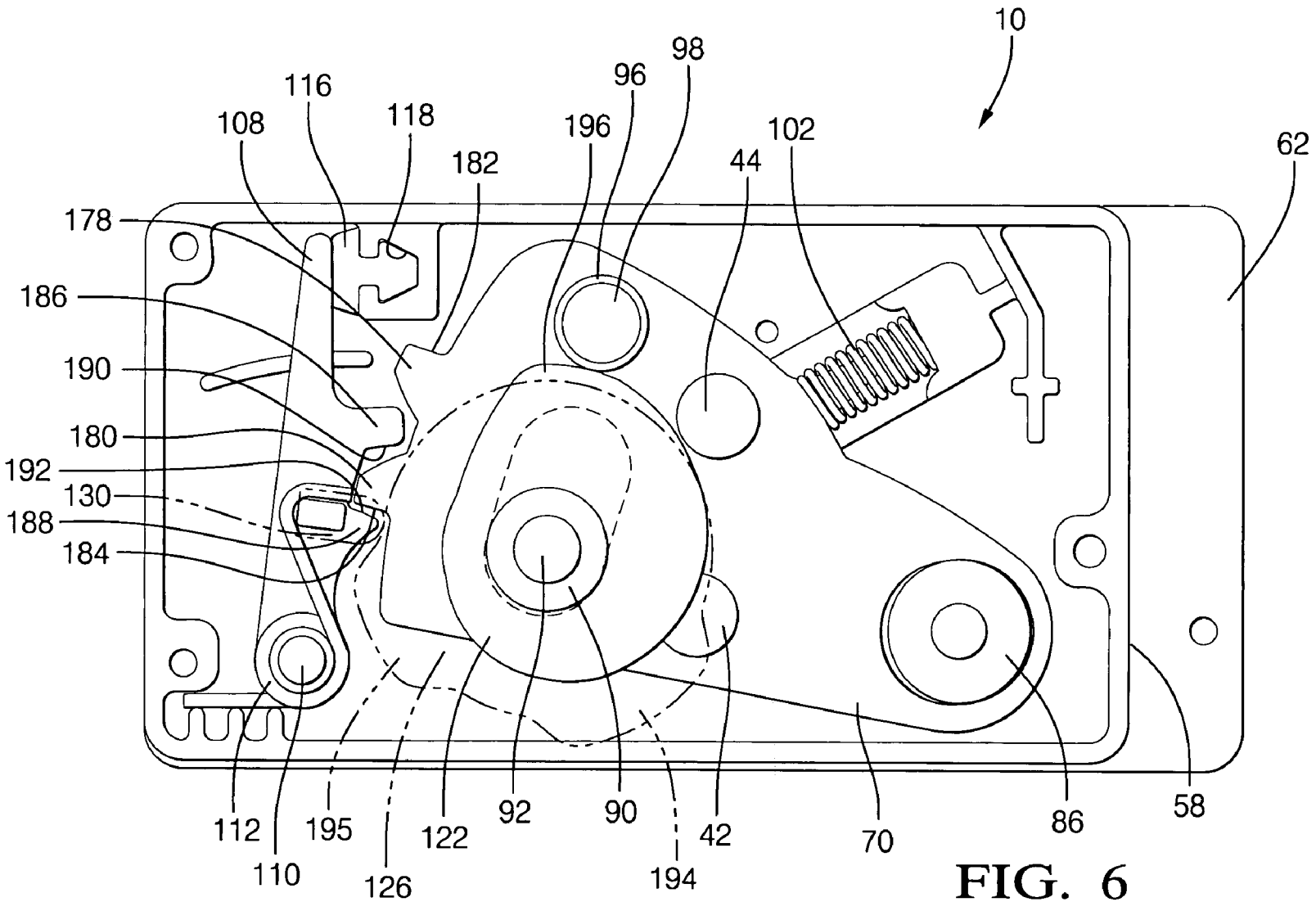
FIG. 6, is a cross-sectional view of the power cinching striker assembly similar to FIG. 5, but with the striker and striker plate disposed in a latched position.

Referring to FIGS. 5 and 6, the range of movement of the striker plate 70 and detent lever 108 under various operating conditions of the striker assembly 10 are illustrated. FIG. 5 depicts the striker plate 70 in its first end limit of travel, corresponding with the system being in the pre-latch or presented position. FIG. 6 depicts the striker plate 70 in its second end limit of travel, corresponding with the system being in the closed or cinched position.

Striker plate 70 and detent lever 108 define facing, cooperating edge surfaces 174 and 176, respectively, which provide a detent function when the striker plate 70 is in its first limit of travel (FIG. 5) and an interlock function when the striker plate 70 is in its second limit of travel (FIG. 6). Edge surface 174 of striker plate 70 includes two leftwardly extending protuberances 178 and 180 defining opposed abutment faces 182 and 184, respectively. Edge surface 176 of detent lever 108 includes two rightwardly extending protuberances 186 and 188 defining facing abutment surfaces 190 and 192, respectively.

FIG. 5 depicts striker assembly 10 with a detent, comprising abutment surfaces 182 and 190, engaged to retain striker plate 70 in the illustrated presented position. Prior to engagement of the latch 26 with the striker member 38, the detent and compression spring 102 serve to hold the striker plate 70 in its illustrated position.

During normal operation, engagement of the latch 26 and striker member 38 will result in a control signal energizing the D.C. motor 154, which will drivingly rotate the striker plate cam 122, detent lever cam 126 and switch cam 128 in a clockwise direction as viewed in FIGS. 4 and 5. The striker plate cam 122 and detent lever cam 126 are phased whereby a first lobe 194 of detent lever cam 126 will initially rotationally displace the detent lever 108 (via its sliding engagement with follower 130, which is illustrated in phantom for the sake of clarity) counterclockwise away from the striker plate 70, providing rotational clearance there between. Thereafter, the lobe 196 of the striker plate cam 122 will act upon the roller bearing 96 to displace the striker plate 70 from its presented position (FIG. 5) to its cinched position (FIG. 6). As the three cams continue to rotate, the detent lever cam 126 (in phantom) will release the detent lever 108, which, under the influence of torsion spring 112 will return to the position depicted in FIG. 6, wherein abutment surfaces 184 and 192 are facing one another in the interlocked position.

For the purposes of this patent, a "detent" is a mechanical engagement which restrains the striker plate 70 in its position in FIG. 5 and which can be released with or without the presence of the control signal by the application of a predetermined impact load (caused by manual slamming shut of the closure member 16). An "interlock" is a positive mechanical engagement, which restrains the striker plate 70 in its position in FIG. 6 and which can only be released in the presence of the control signal which effects displacement of the detent lever 108 via rotary action of detent lever cam 126.

Abutment surfaces 182 and 184 of protuberances 178 and 180, respectively, are generally parallel to the line of elongation of the striker plate 70. As illustrated in both FIGS. 5 and 6, abutment surface 190 of protuberance 186 is angularly offset from the line of elongation of striker plate 70, while abutment surface 192 of protuberance 188 is generally parallel to the line of elongation of striker plate 70. Accordingly, when in the detent position of FIG. 5, abutment surfaces 182 and 190 are in line contact and are slightly diverging. Thus, a high impact force loading will result in protuberance 178 forcing detent lever protuberance 186 leftwardly, permitting displacement of the striker plate 70 and effecting manual cinching of the striker assembly 10. Alternately, when in the interlocked position of FIG. 6, abutment surfaces 184 and 192 are in surface contact and will apply purely compressive loading there between until failure.

When the striker assembly 10 is in the interlocked condition depicted in FIG. 6, and the operator releases the latch 26 from engagement with the striker member 38, either electrically or mechanically, this change of status will be sensed by control circuit 52, which, in turn, will energize motor 154. Motor 154 will drive the three cams clockwise from the positions depicted in FIG. 6. Initially, a second lobe 195 of detent lever cam 126 will displace detent lever 108 counterclockwise away from striker plate 70, thereby releasing the interlock condition. Thereafter, the striker plate cam 122 will continue to rotate as its lobe 196 rotates away from roller bearing 96, returning the striker plate 70 to the presented position depicted in FIG. 5.

Figure 7:
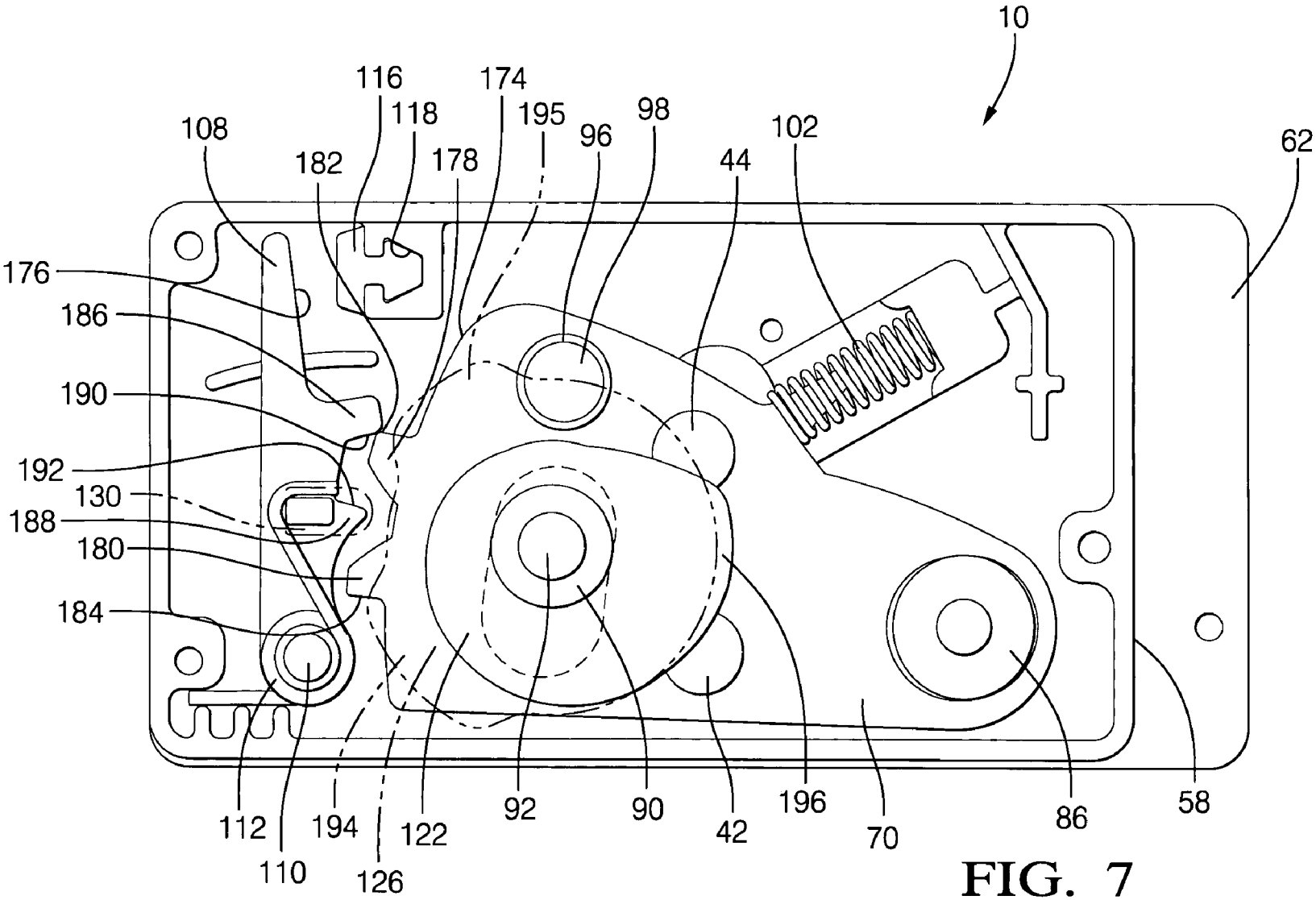
FIG. 7, is a cross-sectional view of the power cinching striker assembly similar to FIG. 5, but with the striker and striker plate disposed in an intermediate position between the cinched and presented positions as a result of being manually overridden.
Figure 8:
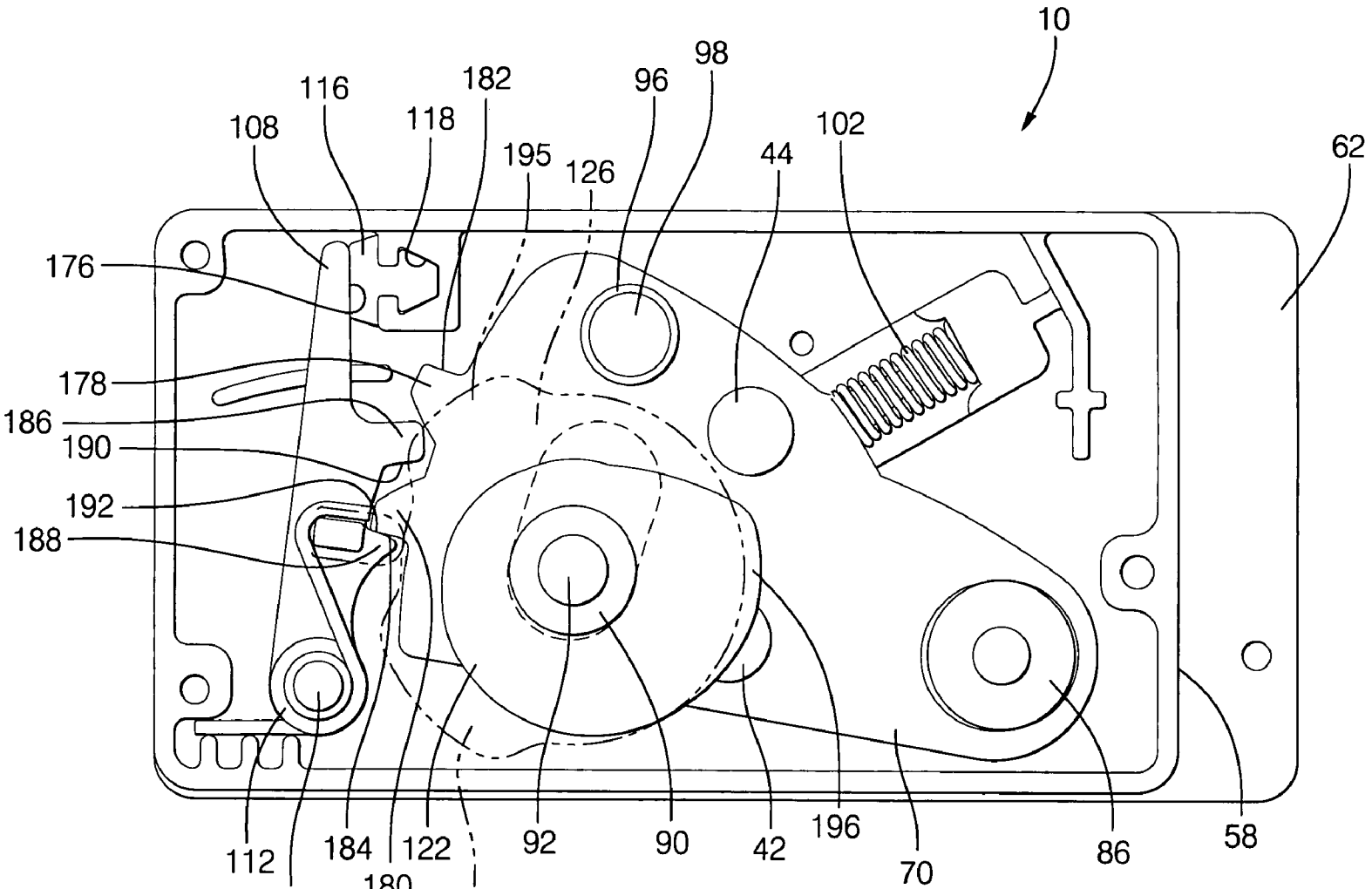
FIG. 8 is a cross-sectional view of the power cinching striker assembly similar to FIG. 5, but with the striker and striker plate disposed in the latched position as a result of being manually overridden.

Referring to FIGS. 7 and 8, the loss of power "over-ride" feature is illustrated. FIG. 7 depicts the initial displacement of the striker plate 70 as a result of normal manual operation of the door or closure member 16 without the presence of electrical power. The preferred design of the power striker assembly 10 can withstand a 75 J slam without damage to the mechanism. As the striker plate 70 moves from the presented position, the roller bearing 96 separates from contact with the striker plate cam 122, and the edge of abutment surface 182 of striker plate 70 "wipes" along the angled abutment surface 190 of detent lever 108. As striker plate 70 continues to rotate, striker plate protuberance 178 passes beyond protuberance 186 of detent lever 108, which is then resiliently biased back towards the position depicted in FIGS. 5 and 6 by torsion spring 112. Finally, as best viewed in FIG. 8, as the striker plate 70 approaches its cinched position, abutment face 184 of protuberance 180 of striker plate 70 passes beyond abutment surface 192 of protuberance 188 of detent lever 108, torsion spring 112 urges the detent lever protuberance 188 inwardly behind striker plate protuberance 180, thereby interlocking the striker plate 70 in its cinched position as depicted in FIG. 8.

As described herein above in relation to FIG. 2, slot 74 in striker plate 70 is elongated generally along its line of elongation. Slot 76 is crescent shaped and elongated in a direction substantially offset from the line of elongation of slot 74. Finally, the first or striker leg 42 of the striker member 38 is positioned intermediate slots 74 and 76 and, in the illustrated preferred embodiment, is slightly radially offset there from.

The applicants have discovered that the end of the striker plate 70 associated with slot 74 is subjected primarily to translational movement along the line of elongation as the striker plate 70 transitions between its end limits of travel, and that the end of the striker plate 70 associated with the second slot 76 is subjected primarily to rotational movement as the striker plate 70 transitions between its end limits of travel. This hybrid motion in the two dimensional plane defined by bottom wall 72 of lower housing portion 60 subjects the striker plate 70 to simultaneous translation and rotation. Furthermore, the applicants have determined that the judicious selection of a specific point on the surface of the striker plate 70 will result in linear displacement of that point as the striker plate traverses its end limits of travel. The striker leg 42 is mounted concentrically at that point.

In practice, the identification of the optimal mounting location of the striker leg 42 can be established by mathematical modeling or by empirical development and can be accomplished by one of ordinary skill in the art in view of the forgoing teaching without undue experimentation.

It is contemplated that a striker boot (not illustrated) can be provided to close elongated opening 66 of wall 30 from intrusion of water, contaminants and the environment matter while enhancing the overall appearance of the design of the preferred embodiment of the invention.

Figure 9:
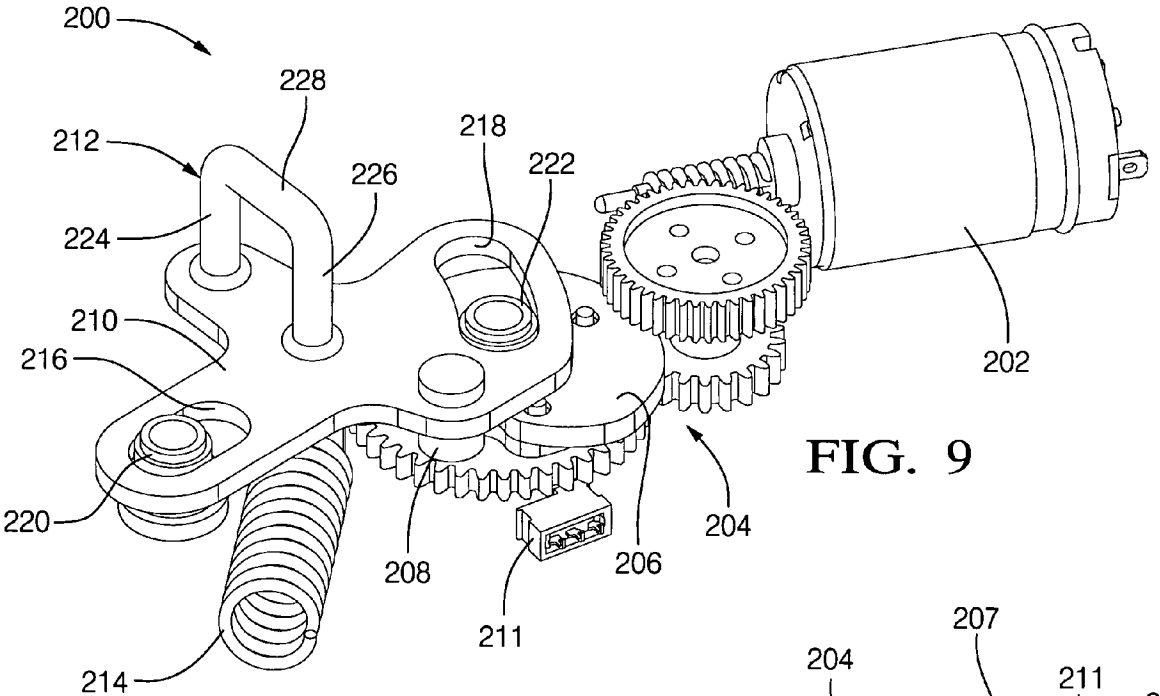
FIG. 9, is a front perspective view of a simplified alternative embodiment of the inventive power cinching striker assembly.
Figure 10:
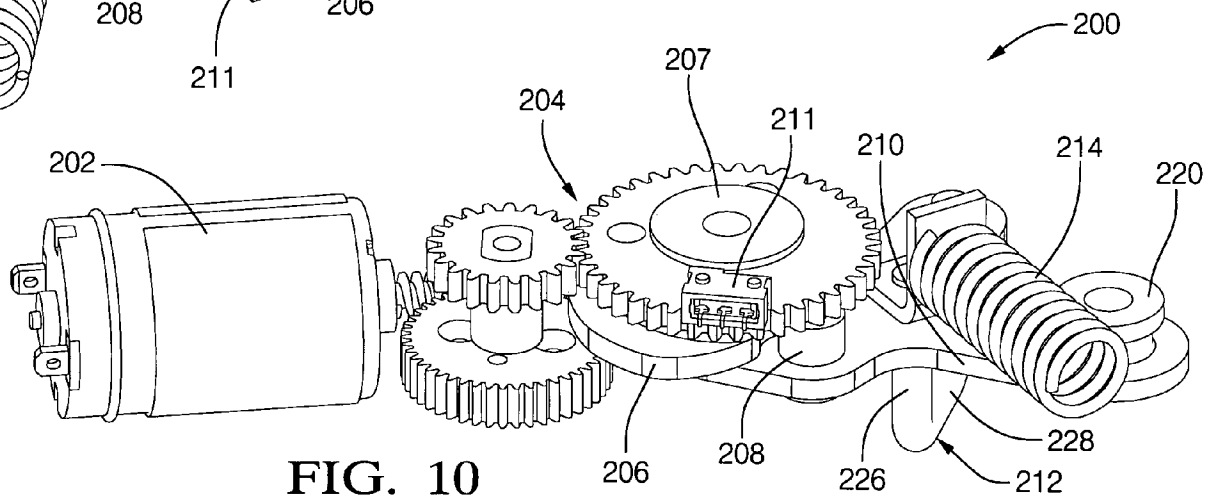
FIG. 10, is a back perspective view of the alternative power cinching striker assembly of FIG. 9.
Figure 11:
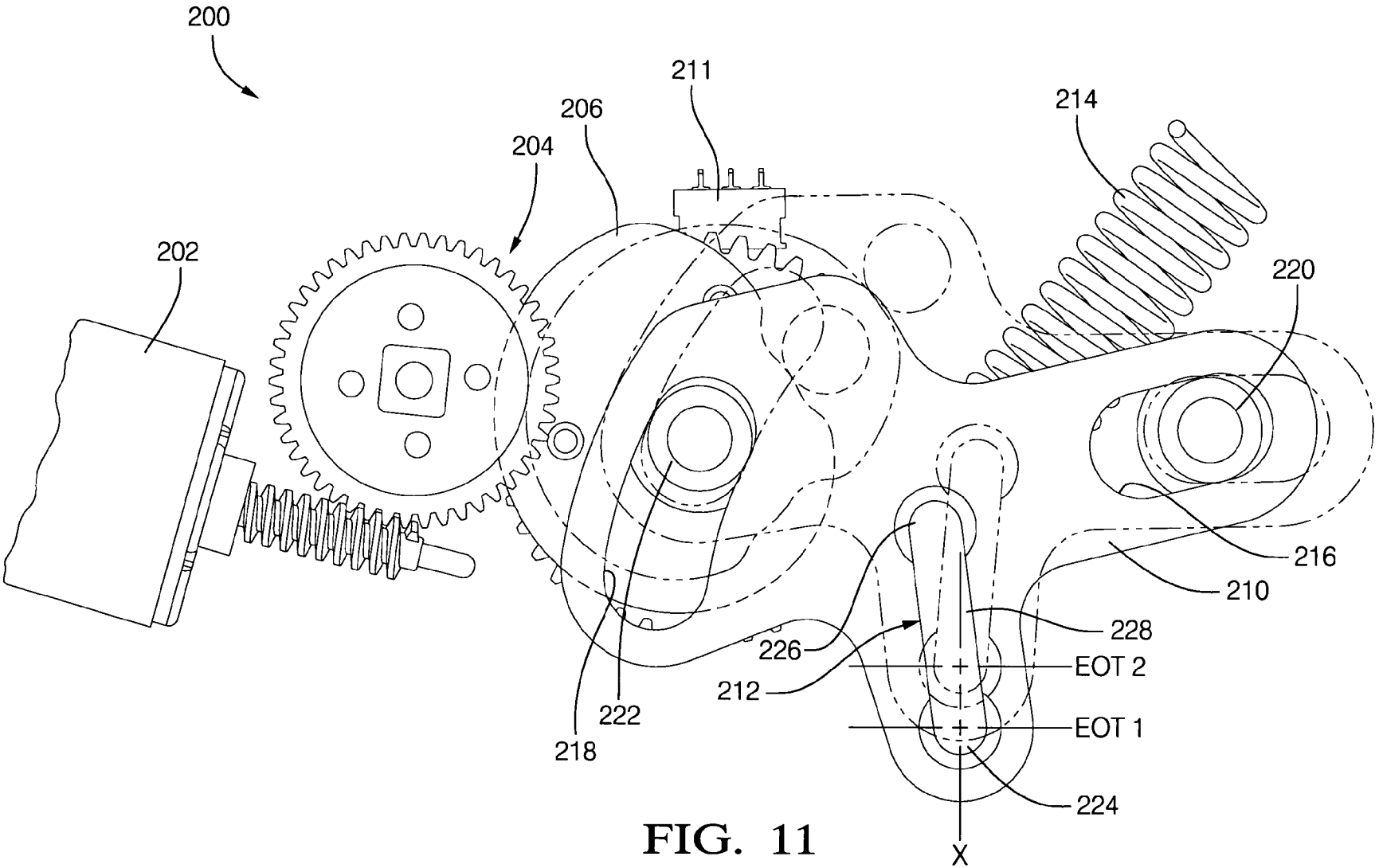
FIG. 11, is a partial broken front plan view of the power cinching striker assembly of FIG. 8, on an enlarged scale.

Referring to FIGS. 9 through 11, an illustrative model of a drive mechanism 200 of a power cinching striker assembly sans housing is illustrated. The drive mechanism 200 includes a D.C. motor 202 driving a gear reduction stage 204, which, in turn, drives a striker plate cam 206 and a phased switch cam 207. Striker plate cam 206 is in rolling contact with a cam follower 208 carried by a striker plate 210, which, in turn, carries a striker member 212. Phased switch cam 207 is in rolling contact with a contact switch 211. A compression spring 214 continuously urges the striker plate 210 toward its presented position as illustrated in hard line in FIG. 11.

Except as otherwise indicated, the embodiment and application of the invention depicted in FIGS. 9 through 11 operates in all material respects as described herein above with regards to the embodiment of FIGS. 1 through 8.

Referring to FIG. 11, the striker plate 210 is horizontally elongated, defining a first slot 216 which is elongated generally parallel with the line of elongation of the striker plate 210 and a second generally crescent shaped slot 218 which is elongated along an axis which is offset from the axis of elongation of the striker plate 210. Bushings 220 and 222 extend through slots 216 and 218, which are adapted for affixation to a housing assembly (not illustrated).

Striker member 212 comprises a first or striker leg 224 and a second or support leg 226 interconnected at the free ends thereof by a bridge member 228. Striker leg is concentrically disposed on the precise location of striker plate 210 determined to move linearly as striker plate 210 translates between ins end limits of travel. In FIG. 11, striker plate 210 is depicted in hard line in its pre latch or presented position and is depicted in phantom in its closed or cinched position. The axis of striker leg 224 in the presented position is designated as the intersection of the line of travel designated X and the crossing line designated EOT1 (end of travel 1). The axis of striker leg 224 in the cinched position is designated as the intersection of the line of travel X and the crossing line designated EOT2 (end of travel 2). Thus configured, as the striker plate 210 simultaneously translates and rotates between its end limits of travel, the centerline of the striker leg 224 moves linearly along line X, providing the cost, packaging and performance advantages described herein above.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basic constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, the striker leg can be repositioned on the locus of points of potential linear travel on the striker plate to increase or decrease its length of linear travel without retooling the various striker assembly components. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than is specifically described.

The invention claimed is:

1. A power striker assembly for effecting final positioning of a closure member on an associated vehicle, said power striker assembly comprising:

a fixed frame adapted for attachment to said vehicle adjacent said closure member;

a striker member positionable to selectively engage said closure member and to subsequently displace said closure member from an extended or open position to a retracted or closed position;

a striker plate carrying said striker member;

guide means interconnecting said frame and striker plate operative to effect simultaneous translational and rotational displacement of said striker plate between first and second end limits of travel resulting in substantially linear displacement of said striker member between said extended and retracted positions, wherein said striker plate reciprocates about an axis of elongation defined by said striker member;

actuator means operable to selectively displace said striker plate between said end limits of travel; and means to selectively alternatively latch said striker plate in each of said end limits of travel.

2. The power striker assembly of claim 1, wherein said guide means comprises, first and second bushings carried with said frame, and first and second guide surfaces defined by said striker plate, said first bushing and first guide surface disposed in continuous sliding engagement and said second bushing and second guide surface disposed in continuous sliding engagement throughout transition of said striker plate between said end limits of travel.

3. The power striker assembly of claim 2, wherein said first and second bushings are directly affixed to said frame.

4. The power striker assembly of claim 2, wherein said first and second guide surfaces are defined by first and second elongated slots formed in said striker plate.

5. The power striker assembly of claim 4, wherein said first and second elongated slots define characteristic axes of elongation which are substantially angularly offset from one another.

6. The power striker assembly of claim 4, wherein at least one of said elongated slots define a curvilinear guide surface.

7. The power striker assembly of claim 4, wherein said first and second elongated slots are spaced from one another.

8. The power striker assembly of claim 2, wherein said striker member is affixed to said striker plate intermediate said first and second guide surfaces.

9. The power striker assembly of claim 1, wherein said striker plate is substantially flat and is displaceable within a two-dimensional plane defined by said frame.

10. The power striker assembly of claim 1, wherein said striker member is affixed to and extends normally from said striker plate.

11. The power striker assembly of claim 1, wherein said striker member comprises one leg of a generally "u" shaped striker element.

12. The power striker assembly of claim 1, wherein said actuator means comprises a transmission drivingly interconnecting an electric motor with said striker plate.

13. The power striker assembly of claim 12, further comprising control means operative to electrically energize said actuator means for uni-rotational operation of said motor.

14. The power striker assembly of claim 1, further comprising means operative to sense the position of said striker plate and to provide a feedback signal to said actuator means as a function thereof.

15. A power striker assembly for effecting final positioning of a closure member on an associated vehicle, said power striker comprising:

a housing including a fixed frame adapted for attachment to said vehicle adjacent said closure member;

a striker member positionable to selectively engage said closure member and to subsequently displace said closure member from an extended or open position to a retracted or closed position;

a substantially flat, elongated striker plate carrying said striker member;

guide means interconnecting said frame and striker plate operative to effect simultaneous translational and rotational displacement of said striker plate between first and second end limits of travel resulting in substantially linear displacement of said striker member between said extended and retracted positions, said striker plate being displaceable within a two-dimensional plane defined by said frame, said guide means including first and second bushings carried with said frame within said housing and first and second guide surfaces defined by said striker plate, said first bushing and first guide surface disposed in continuous sliding engagement and said second bushing and second guide surface disposed for continuous sliding engagement throughout transition of said striker plate between said end limits of travel;

an electric drive motor;

transmission means interconnecting said motor and striker plate to selectively drive said striker plate from said first end limit of travel to said second end limit of travel;

means to continuously bias said striker plate towards said first limit of travel; and latch means operative to selectively secure said striker plate at each of said end limits of travel.

16. The power striker of claim 15, wherein said first and second bushings define attachment points for affixation of said striker assembly to an associated vehicle.

17. A power striker assembly for effecting final positioning of a closure member on an associated vehicle, said power striker assembly compromising:

a fixed frame adapted for attachment to said vehicle adjacent said closure member;

a striker member positionable to selectively engage said closure member and to subsequently displace said closure member from an extended or open position to a retracted or closed position;

a striker plate carrying said striker member;

guide means interconnecting said frame and striker plate operative to effect simultaneous translational and rotational displacement of said striker plate between first and second end limits of travel resulting in substantially linear displacement of said striker member between said extended and retracted positions, wherein said striker plate reciprocates about an axis of elongation defined by said striker member;

actuator means operable to selectively displace said striker plate between said end limits of travel; and means to continually bias said striker plate towards one of said end limits of travel, wherein said means to continually bias said striker plate comprises a spring, and wherein said spring is continuously compressively loaded between said striker plate and said fixed frame.

* * * * *